US009107246B2

(12) United States Patent
Battaglia

(10) Patent No.: US 9,107,246 B2
(45) Date of Patent: Aug. 11, 2015

(54) METHOD AND SYSTEM FOR SHUTTING DOWN A LIGHTING DEVICE

(71) Applicant: Phoseon Technology, Inc., Hillsboro, OR (US)

(72) Inventor: Salvatore T. Battaglia, Vancouver, WA (US)

(73) Assignee: Phoseon Technology, Inc., Hillsboro, OR (US)

( * ) Notice: Subject to any disclaimer, the term of this patent is extended or adjusted under 35 U.S.C. 154(b) by 91 days.

(21) Appl. No.: 13/762,001

(22) Filed: Feb. 7, 2013

(65) Prior Publication Data

US 2014/0062327 A1 Mar. 6, 2014

Related U.S. Application Data

(60) Provisional application No. 61/697,252, filed on Sep. 5, 2012.

(51) Int. Cl.
*H05B 37/02* (2006.01)
*H05B 39/04* (2006.01)
*H05B 33/08* (2006.01)

(52) U.S. Cl.
CPC ..... *H05B 37/02* (2013.01); *H05B 33/0845* (2013.01); *H05B 37/029* (2013.01)

(58) Field of Classification Search
CPC .... H05B 37/02; H05B 37/029; H05B 39/045; H05B 41/2825
USPC ..... 315/210, 312
See application file for complete search history.

(56) References Cited

U.S. PATENT DOCUMENTS

| | | | | |
|---|---|---|---|---|
| 6,775,784 | B1 | 8/2004 | Park | |
| 7,304,871 | B2 * | 12/2007 | Ito et al. | 363/59 |
| 7,705,575 | B2 | 4/2010 | Akyildiz et al. | |
| 7,906,952 | B2 | 3/2011 | Kuo et al. | |
| 8,120,343 | B2 | 2/2012 | Kunimatsu | |
| 8,143,748 | B2 | 3/2012 | Ochi | |
| 8,148,919 | B2 | 4/2012 | Liu et al. | |
| 8,212,538 | B2 | 7/2012 | Nishida | |
| 8,692,535 | B1 * | 4/2014 | Sreenivas et al. | 323/285 |
| 2009/0115343 | A1 | 5/2009 | King | |
| 2009/0273290 | A1 * | 11/2009 | Ziegenfuss | 315/193 |
| 2010/0201283 | A1 * | 8/2010 | Kawata et al. | 315/287 |
| 2010/0328946 | A1 | 12/2010 | Borkar et al. | |
| 2012/0032610 | A1 | 2/2012 | Kang | |
| 2012/0043893 | A1 | 2/2012 | Sadwick et al. | |
| 2013/0038819 | A1 * | 2/2013 | Ishikawa | 349/69 |
| 2014/0077790 | A1 * | 3/2014 | Sohma | 323/313 |
| 2014/0320019 | A1 * | 10/2014 | Smith | 315/130 |

OTHER PUBLICATIONS

ISA Korean Intellectual Property Office, International Search Report and Written Opinion of PCT/US2013/054762, Nov. 26, 2013, 9 pages.

* cited by examiner

*Primary Examiner* — Dylan White
(74) *Attorney, Agent, or Firm* — Alleman Hall McCoy Russell & Tuttle LLP

(57) ABSTRACT

A system and method for operating one or more light emitting devices is disclosed. In one example, the switching of a regulator is ceased in response to a request to stop supplying power to one or more light emitting devices. The approach may reduce power consumption of a lighting system when light is not requested.

15 Claims, 6 Drawing Sheets

METHOD AND SYSTEM FOR SHUTTING DOWN A LIGHTING DEVICE

CROSS-REFERENCE TO RELATED APPLICATIONS

This application claims priority to U.S. Provisional Patent Application No. 61/697,252, entitled "Method and System for Shutting Down a Lighting Device", filed Sep. 5, 2012, the entirety of which is hereby incorporated by reference for all purposes.

BACKGROUND/SUMMARY

LED lights are an efficient replacement for incandescent and florescent lights. Some LED lights may be configured in an array or matrix so that the output of many individual LEDs may be combined. The result is a bright yet efficient light source. The LED array may be supplied electrical power via a direct current (DC) power source. The DC power source may be designed as a linear or switching power source. Switching DC power sources may operate more efficiently while the LEDs are illuminated; however, the switching power source may not operate as efficiently when the LED lights are turned off. The reduced efficiency of the switching power supply may be a result of switching at the power source.

The inventor herein has recognized the above-mentioned disadvantages and has developed a system operating one or more light emitting devices, comprising: a discrete voltage regulating circuit including a switching device and a voltage reference source; and a switching device deactivation circuit including a switch positioned in a first current path between the voltage reference source and ground.

By placing a switching device between a voltage reference source and ground, it may be possible to reduce electrical power consumed by a lighting system when light is not requested. Specifically, when the switching device is adjusted to a closed state, a signal provided by the voltage reference source may be driven toward ground so that the switching device remains in a desired state that reduces lighting system power consumption.

The present description may provide several advantages. Specifically, the approach may reduce the lighting system power consumption when light is not requested. Further, the approach may provide redundant ways to reduce the possibility regulator switching when light is not requested. Further still, the approach may reduce the possibility of power transients occurring when the lighting system is activated and deactivated.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
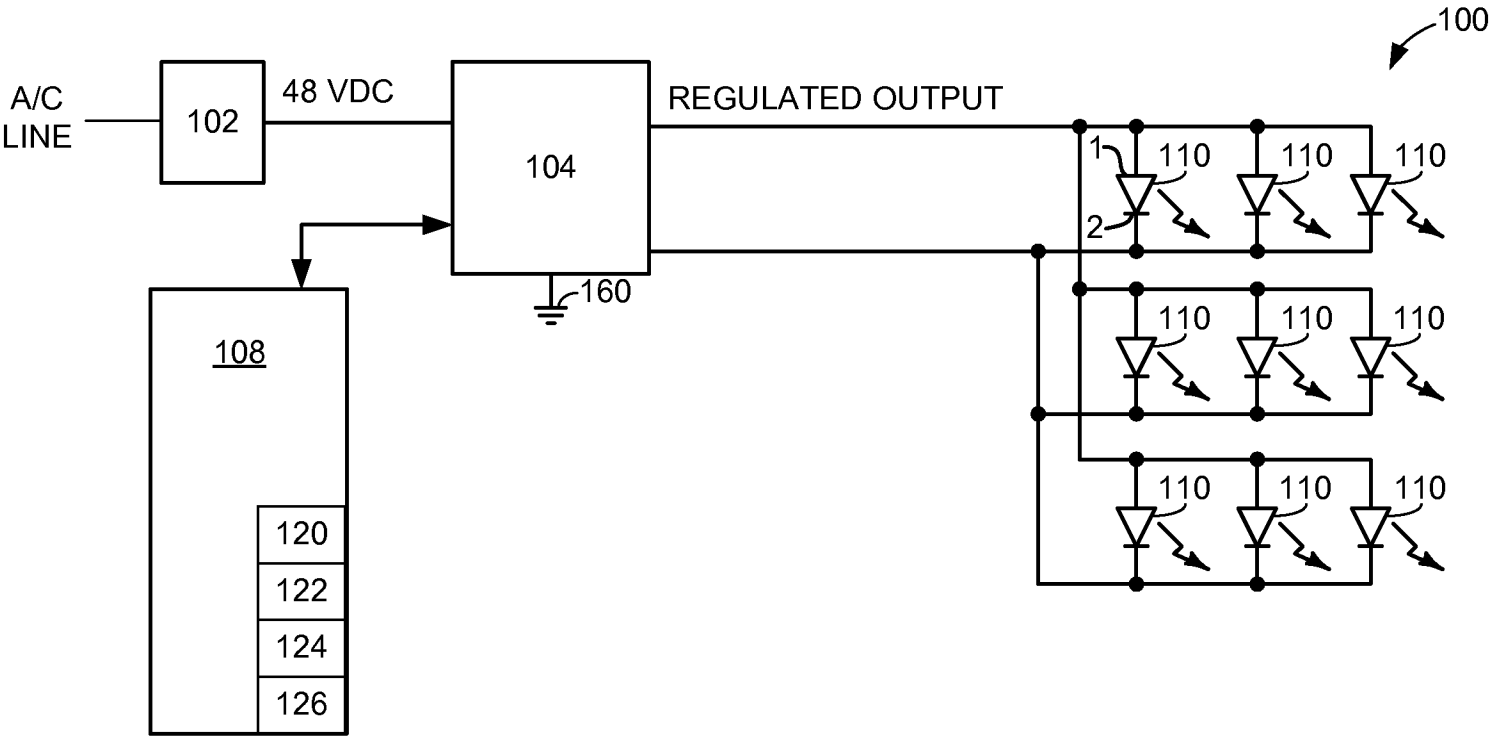
FIG. 1 shows a schematic depiction of a lighting system.
Figure 2A:
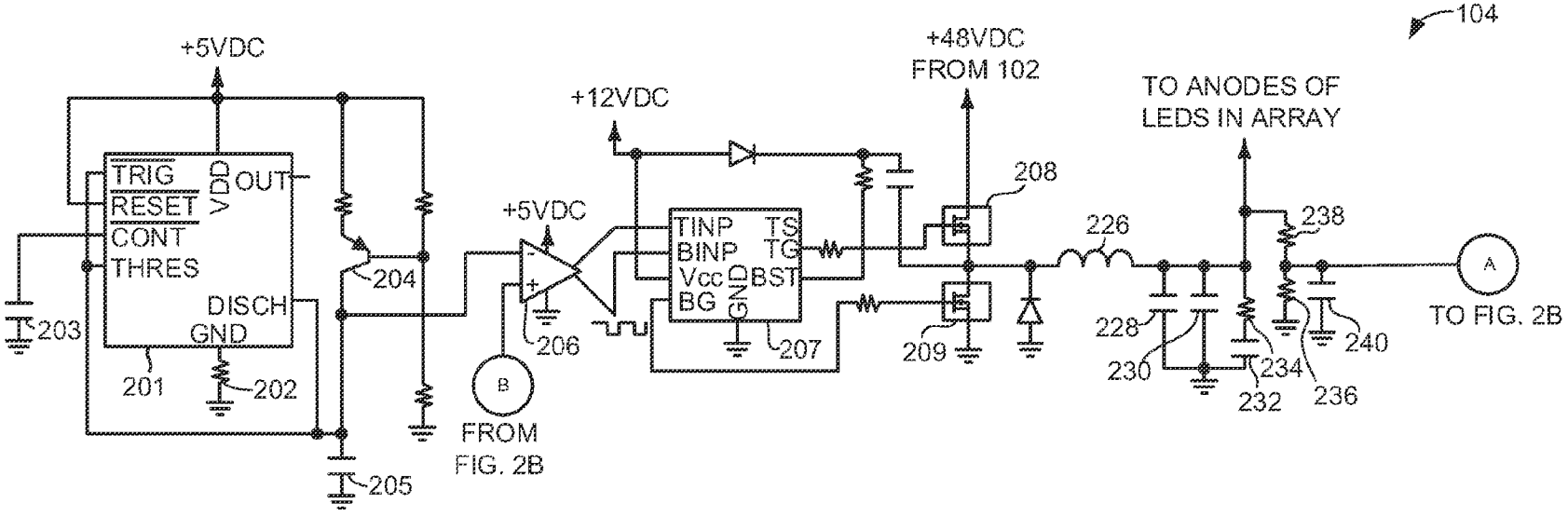
FIGS. 2A, 2B and 2C show a schematic of an example voltage regulating system.
Figures 2B, 2C:
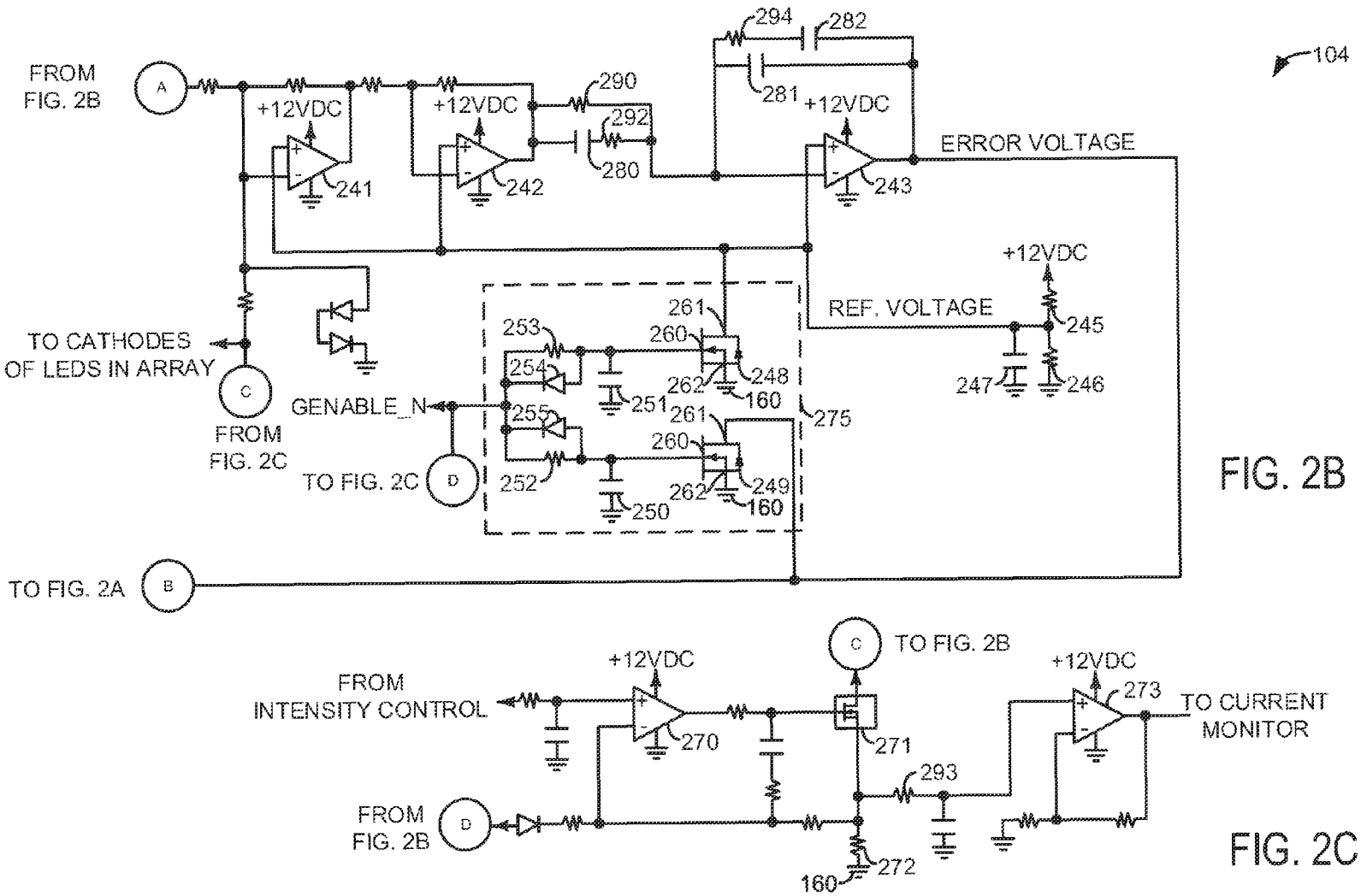
Figure 3:
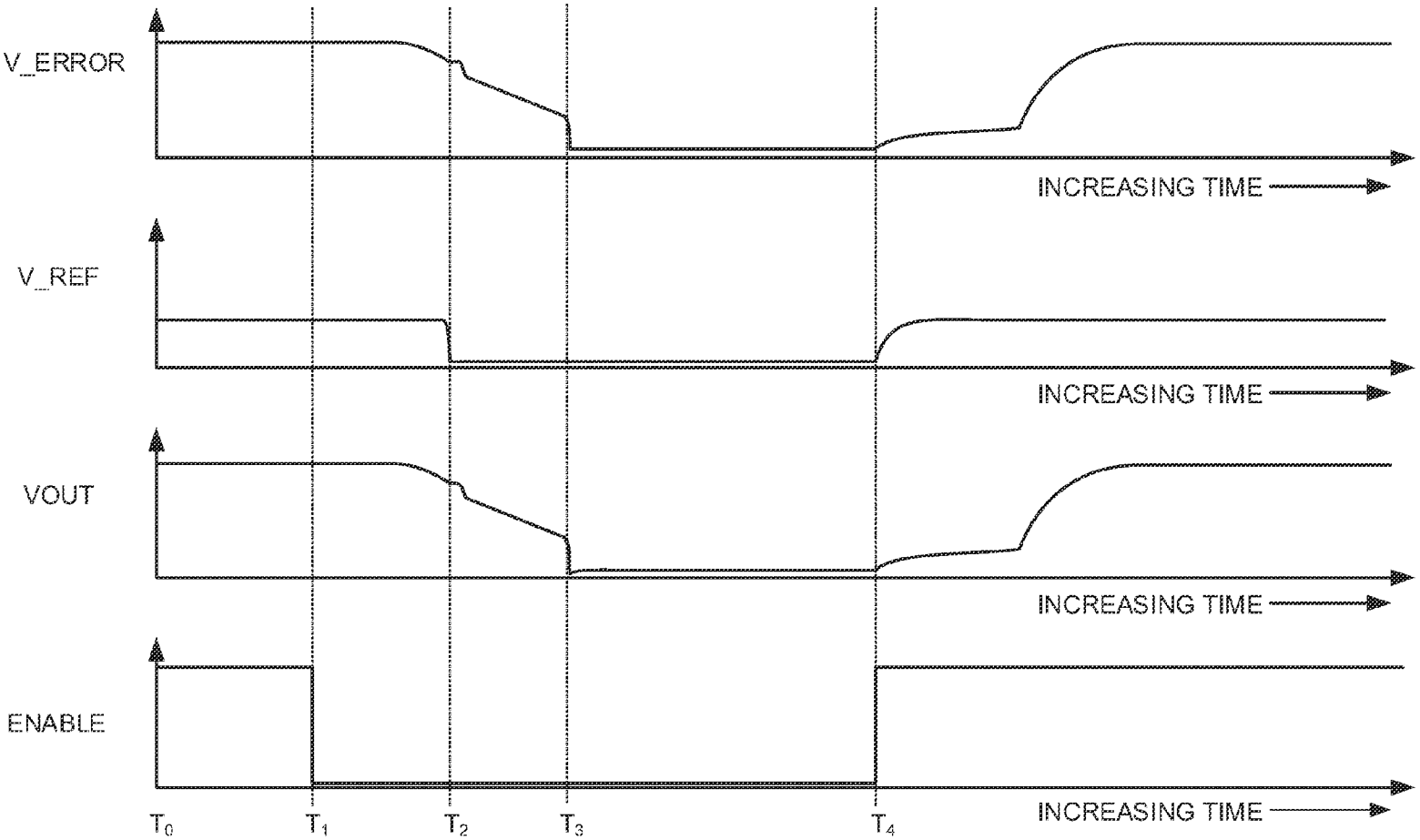
FIG. 3 shows prophetic voltage regulating system operating sequence.
Figure 4:
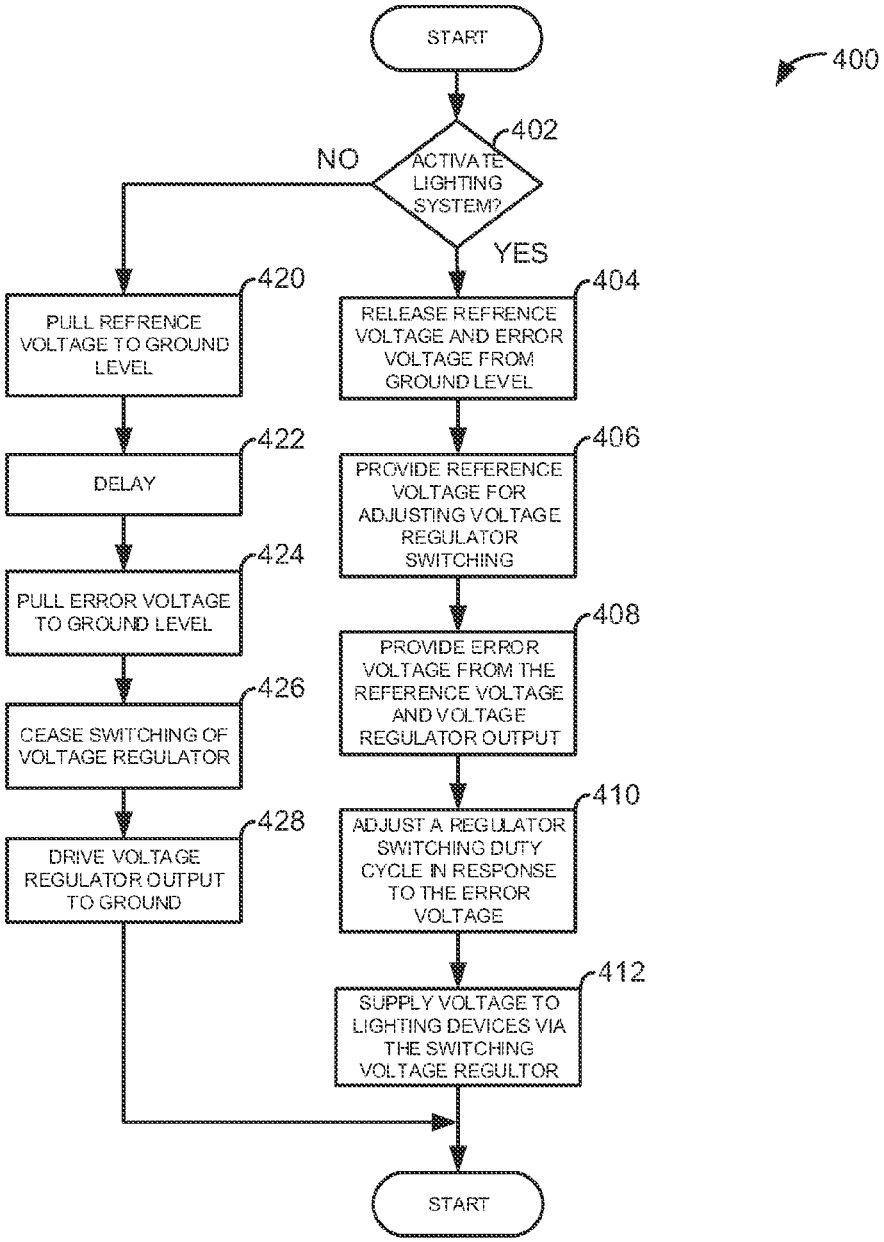
FIG. 4 shows an example method for operating a lighting system.

The present description is related to providing a lighting system with reduced power consumption during periods when light is not requested. FIG. 1 shows one example system for providing electrical power to one or more light emitting devices. FIGS. 2A-2C show an example system where electrical power consumption may be reduced when light is not requested from a lighting system. FIG. 3 provides an example prophetic operating sequence for a voltage regulator. Finally, FIG. 4 is an example method for operating a lighting system.

Referring to FIG. 1, a schematic of a lighting system is shown. Lighting system 100 includes one or more light emitting devices 110. In this example, light emitting devices 110 are light emitting diodes (LEDs). Each LED 110 includes an anode 1 and a cathode 2. Switching voltage regulator 104 supplies DC power to the anodes 1 of LEDs 110. Switching voltage regulator 104 is also electrically coupled to cathodes 2 of LEDs 110. Switching voltage regulator 104 is shown referenced to ground 160. A controller 108 is shown in electrical communication with switching voltage regulator 104. In other examples, discrete input generating devices (e.g., switches) may replace controller 108, if desired. Controller 108 includes central processing unit 120 for executing instructions. Controller 108 also includes inputs and outputs (110) 122 for operating switching regulator 104. Non-transitory executable instructions may be stored in read only memory 126 while variables may be stored in random access memory 124. Power supply 102 converts alternating current to 48 VDC and directs the 48 VDC to switching regulator 104. LEDs 110 may illuminate when electrical power is supplied to them via switching regulator 104.

Referring now to FIG. 2, a schematic of an example voltage regulating system is shown. Switching voltage regulator 104 includes a PNP transistor 204 that supplies a constant current amount to capacitor 205. Timing circuit 201 operates to pull capacitor 205 toward ground (GND) via an open collector transistor (not shown) and resistor 202. Timing circuit 201 along with PNP transistor 204 and capacitor 205 generate a ramping signal at a frequency that is related to the value of capacitor 203. In one example, timer circuit 201 is a 555 timer. Further, bias resistor 202 holds the DISCH input and capacitor 205 a small voltage (e.g. about 300 mV) above ground so that comparator 206 does not switch when a ground level is present at the non-inverting (e.g., +input) input of comparator 206. In one example, the timing circuit 201, capacitor 205, and PNP transistor 204 provide a 350 KHz ramping signal output to the inverting input of comparator 206.

Comparator 206 receives its non-inverting input from the output of amplifier 243 shown in FIG. 2B. The output of amplifier 243 is a voltage signal that represents a gain adjusted voltage error between an actual voltage and a reference or desired voltage. The actual voltage is produced by summing a voltage between resistors 238 and 236 with a voltage at the cathode side of light emitting devices 110. The voltage at the cathode side of light emitting devices 110 is weighted a greater amount than the voltage between resistors 238 and 236 (e.g., a faction of the regulator output). The reference voltage is provided via a voltage divider comprising resistors 245 and 246. Comparator 206 receives its inverting input (e.g.,–input) from timing circuit 201 including transistor 204 and capacitor 205. The output of comparator 206 goes high when a voltage at the inverting input is greater than the voltage at the non-inverting input. Comparator 206 outputs a pulse train with a varying duty cycle to current driver circuit 207. The pulse train duty cycle is related to an error between an actual voltage provided by summing the weighted lighting device anode and cathode voltages and the reference voltage provided at the node comprising resistors 245 and 246.

Current driver 207 supplies an increased amount of current to switching devices 208 and 209 than may be sourced by comparator 206. In one example, current driver 207 includes a boost converter to increase the voltage supplied to the gate of switching device 208 to a level 12 VDC above the voltage at the source of switching device 208 so that switching device 208 may be activated. Current driver 207 alternatively operates switching device 208 and 209 to selectively charge inductor 226. The output of inductor 226 is filtered via capacitors 228, 230, and 232. Resistor 234 also operates to filter the output of inductor 226. The filtered DC power is then routed to anodes of LEDs 110. Resistors 238 and 236 comprise a voltage divider for measuring and scaling the output voltage from inductor 226. Capacitor 240 filters the output from the voltage divider at resistors 238 and 236. Thus, a switching voltage regulator is provided comprising switching devices 208 and 209. The output from the voltage divider comprising resistors 238 and 236 is directed to a feedback circuit for determining a voltage error based on a desired or reference voltage and an actual voltage as summed from the anode side and the cathode side of light emitting devices 110. The voltage divider output at resistors 238 and 236 passes to FIG. 2B at A.

Referring now to FIG. 2B, the voltage divider output from FIG. 2A is shown at A. As previously mentioned, the voltage divider output is based on the output of inductor 226, and it is input into the inverting input of amplifier 241 along with a scaled version of voltage from the cathode side of LEDs 110. In particular, the voltage from the voltage divider provided by resistors 236 and 238 is added to the voltage from the cathode side of LEDS 110, and the summed result is output by amplifier 241 to amplifier 242. Amplifier 242 is an inverting amplifier, and it outputs an inverted version amplifier 241 output to amplifier 243. The output of amplifier 242 is filtered by amplifier 243, capacitors 280-282, and resistors 290-294 to provide a voltage error that is a scaled difference between the reference voltage and the sum of scaled anode and cathode voltages. The reference voltage is provided via a voltage divider comprising resistors 245 and 246. In one example, the reference voltage is a voltage that is desired at the drain of FET 271. The error voltage is input to comparator 206 as indicated by B.

Switching voltage regulator 104 also includes a switching device deactivation circuit 275. Switching device deactivation circuit 275 includes switches 248 and 249 which are shown as FETs in this example, but alternative switching devices such as JFETS, MOSFETs, bipolar transistors may also be used. For bipolar transistors gates 260 are replaced by transistor base inputs and drains 261 and sources 262 are replace by emitters and collectors.

Switching device deactivation circuit 275 also includes resistors 252-253, capacitors 251-250, and diodes 254-255. The source of switching device 248 is in electrical communication with ground 160. Similarly, the source of switching device 249 is in electrical communication with ground 160. The drain of switching device 248 is electrically coupled to the reference voltage produced at resistors 245 and 246. The drain of switching device 249 is electrically coupled to the error voltage output from amplifier 243. The gate of switching device 248 is in electrical communication with capacitor 251, resistor 253, and diode 254. The gate of switching device 249 is in electrical communication with capacitor 250, resistor 252, and diode 255. Diode 254 is in parallel with resistor 253, and diode 255 is in parallel with resistor 252. The anode of diode 254 is electrically coupled to one side of capacitor 251. The other side of capacitor 251 is electrically coupled to ground. The anode of diode 255 is electrically coupled to one side of capacitor 250. The other side of capacitor 250 is electrically coupled to ground. The cathode of diodes 254 and 255 are electrically coupled and are in electrical communication with a switching device deactivating circuit control source GENABLE_N which may originate from controller 108 shown in FIG. 1. The signal GENABLE_N is a global enable signal for lighting system 100 that has been inverted.

Switching device deactivation circuit 275 operates in response to the GENABLE_N input. In particular, capacitors 250 and 251 are charged to a level of a higher level input voltage at the GENABLE_N input when the higher level voltage is applied by controller 108 or through a switch. Capacitors 250 and 251 are charged at a rate that depends on the values of resistors 252 and 253. The values of resistors 252 and 253 along with the values of capacitors 250 and 251 determine how long it takes for FETs 248 and 249 to begin to conduct after a higher level voltage is applied at the GENABLE_N input. Voltage of capacitors 250 and 251 approach the higher level voltage when GENABLE is high, and the voltages at capacitors 250 and 251 are applied to the gates 260 of FETs 248 and 249. The higher level voltage at gates 260 activates FETs 248 and 249 so that current may flow in a path from drain side 261 to source side 262.

Thus, FET 248 connects the reference voltage provided at resistors 245 and 246 to ground 160 when FET 248 is conducting. Additionally, FET 249 connects the error voltage output from amplifier 243 to ground 160 via a current path when FET 249 is conducting. In this way, the error voltage output and the reference voltage may be changed to substantially ground level (e.g., within less than 300 mV of ground). Further, the reference voltage between resistors 245 and 246 is pulled to ground when it is desired to not illuminate lighting devices 110. Similarly, the error voltage from the output of amplifier 243 is pulled to ground when it is desired to not illuminate lighting devices 110.

In one example, the values of resistor 253 and capacitor 251 are selected such that the reference voltage goes to ground approximately 2 ms after a request to deactivate the switching device is made. The values of resistor 252 and capacitor 250 are selected such that the error voltage goes to ground approximately 4 ms after a request to deactivate the switching device is made. In this way, the switching device deactivation circuit 275 controls the shutdown of switching devices 208 and 209.

Diodes 254 and 255 are reverse biased when the higher level voltage is applied at the GENABLE_N input, and only leakage current flows through diodes 254 and 255. It should also be mentioned that current flows from the GENABLE_N input to capacitors 250 and 251 when a higher level voltage is applied at the GENABLE_N input.

Driving or pulling the reference voltage toward ground causes feedback amplifiers 241-243 to provide an error voltage that drives the output of inductor 226 to ground via stopping the switching of switching devices 208 and 209. Driving the error voltage to ground via FET 249 adjusts the non-inverting input of comparator 206 to a lower level than the inverting input of comparator 206. As a result, comparator 206 ceases to output the pulse width modulated signal and current driver 207 also ceases to output a pulse width modulated signal to switching devices 208 and 209. As previously discussed, resistor 202 biases the voltage at capacitor 205 that is applied to the non-inverting input of comparator 206 to a minimum level (e.g., 300 mV) that is greater than the input voltage of the non-inverting input of comparator 206 when the error voltage is pulled toward ground via FET 249. Consequently, switching devices 208 and 209 remain deactivated and the output of inductor 226 is stopped.

The switching device deactivation circuit 275 is deactivated when a lower level voltage is applied by controller 108 or through a switch to the GENABLE_N input. A lower level input (e.g., ground) causes diodes 254 and 255 to become forward biased based on charge stored in capacitors 251 and 250. Diodes 254 and 255 conduct when forward biased and current flows from capacitors 250 and 251 to the GENABLE_N input. In this way, charge is drained from capacitors 250 and 251 and current flow through FETs 248 and 249 is stopped without delay. As a result, the voltage at gates 260 approach ground when the GENABLE_N input is at a lower level (e.g., ground). FETs 248 and 249 stop conducting when gates 260 are grounded. In this way, the reference voltage between resistors 245 and 246 is released and allowed to return from ground to the desired reference voltage when it is desired for the lights to illuminate. The current path between ground and the error voltage is interrupted or open circuited when FET 249 stops conducting. Similarly, the current path between ground and the reference voltage between resistors 245 and 246 is interrupted or open circuited when FET 248 stops conducting.

Referring now to FIG. 2C, switching voltage regulator 104 also includes amplifier 270 which provides a varying voltage to FET 271 when GENABLE_N from FIG. 2B is at a low level. Current flow through lighting devices 110 may be regulated by FET 271. FET 271 is operated in a linear mode so that a plurality of different levels of current may flow through lighting devices 110 to control light intensity. Resistor 272 is positioned between the source of FET 271 and ground 160. A voltage that develops across resistor 272 that is indicative of current flow through lighting system 100. Voltage at resistor 272 is input to amplifier 273 via resistor 293. Amplifier 273 applies a gain to the voltage at resistor 272 and outputs a voltage to a current monitor input of controller 108.

Thus, the system of FIGS. 1-3 provides for a system for operating one or more light emitting devices, comprising: a discrete voltage regulating circuit including at least one switching device and a voltage reference source; and a switching device deactivation circuit including a switch positioned in a first current path between the voltage reference source and ground. The system further comprises a controller including executable non-transitory instructions for selectively activating and deactivating the switching device deactivation circuit via the switch. In this way, power consumption of a deactivated lighting system may be reduced.

In one example, the system includes where the switching device is a FET, JFET, MOSFET, or bipolar transistor. The system also includes where the switching device deactivation circuit further comprises a capacitor electrically coupled to a gate or base of the switching device and ground. The system includes where the switching device deactivation circuit further comprises a resistor and a diode in electrical communication with the capacitor and the gate or base of the switching device. The system further comprises a timing circuit, a comparator, and a current driving device, the timing circuit in electrical communication with the comparator, the comparator in electrical communication with the current driving device, and the current driving device in electrical communication with the switching device. The system further comprises a biasing resistor, the biasing resistor positioned between ground and the timing circuit.

In another example, the system of FIGS. 1-3 provides for operating one or more light emitting devices, comprising: a discrete voltage regulating circuit including a switching device, a voltage reference source, and an error voltage source; and a switching device deactivation circuit including a first switch positioned in a first current path between the voltage reference source and ground, the switching device deactivation circuit also including a second switch positioned in a second current path between the error voltage source and ground. The system includes where first and second switches are FETs, JFETs, MOSFETs, or bipolar transistors, the switching device deactivation circuit further comprises a first capacitor electrically coupled to a gate or base of the first switch and ground, and the switching device deactivation circuit further comprises a second capacitor electrically coupled to a gate or base of the second switch and ground.

In some examples, the system includes where the switching device deactivation circuit further comprises a first diode and a first resistor electrically coupled to the first capacitor, and where the switching device deactivation circuit further comprises a second diode and a second resistor electrically coupled to the second capacitor. The system also includes where the first diode, the second diode, the first resistor, and the second resistor are in electrical communication with an enabling signal source. The system further comprises a timing circuit, a comparator, and a current driving device. The system includes where the timing circuit is in electrical communication with the comparator, where the comparator is in electrical communication with the current driving device, and where the current driving device is in electrical communication with the switching device. The system further comprises a bias resistor, the bias resistor positioned between the timing circuit and ground.

Referring now to FIG. 3, a prophetic voltage regulating system operating sequence is shown. The operating sequence applies to the voltage regulating system shown in FIGS. 1-3.

The first plot from the top of FIG. 3 represents an error voltage output from amplifier 243 versus time. The Y axis represents error voltage and the amount of error increases in the direction of the Y axis arrow. The error voltage is an amount of error between an actual voltage produced by summing scaled versions of voltages at the anodes and cathodes of lighting devices and desired or reference voltage output from between resistors 245 and 246. The X axis represents time and time increases from the left side of the plot to the right side of the plot.

The second plot from the top of FIG. 3 represents a reference voltage output from between resistors 245 and 246 versus time. The Y axis represents reference voltage and the reference voltage increases in the direction of the Y axis arrow. The X axis represents time and time increases from the left side of the plot to the right side of the plot.

The third plot from the top of FIG. 3 represents a regulator output voltage versus time. The regulator output voltage corresponds to a scaled voltage at a node between resistors 234 and 238. The Y axis represents regulator output voltage and the regulator output voltage increases in the direction of the Y axis arrow. The X axis represents time and time increases from the left side of the plot to the right side of the plot.

The fourth plot from the top of FIG. 3 represents an enable signal for activating and deactivating lighting devices versus time. The Y axis represents enable signal level. A higher level enable signal indicates that the lighting system is to be activated. A lower level enable signal indicates that the lighting system is to be deactivated. The X axis represents time and time increases from the left side of the plot to the right side of the plot.

At time $T_0$, the enable signal is at a higher level indicating that the lighting system is active and that lighting devices 110 may be illuminated. The voltage error is at a higher level indicating that a correction to the switching regulator output is being made and that the duty cycle of the pulse width modulated switching signal is being controlled. The reference voltage signal is at a constant value (e.g., 0.6 volts) and the switching regulator output voltage is also at a constant level.

At time $T_1$, the enable signal transitions to a lower level in response to a request to deactivate the lighting devices. The enable signal may be provided via a user input or via an output from controller 108. The switching circuit shutdown or deactivation commences when the enable signal goes to a lower state. The error voltage, reference voltage, and regulator output voltage continue at their respective levels for a short period of time.

At time $T_2$, the reference voltage is switched to ground via activating FET 248 in response to an input voltage at the gate of FET 248 exceeding a threshold value. In this example, the reference voltage is switched to ground approximately 2 ms after the enable signal transitions to the lower state. The error voltage is being reduced or slowly decaying toward ground. Likewise, the regulator output voltage is being reduced or slowly decaying toward ground in response to grounding the reference voltage. The enable signal continues at a lower level.

At time $T_3$, the error voltage is switched to ground via activating FET 249 in response to an input voltage at the gate of FET 249 exceeding a threshold value. In this example, the error voltage is switched to ground approximately 4 ms after the enable signal transitions to the lower state. Switching the error voltage to ground drops the duty cycle of the pulse width modulated signal to zero, thereby effectively deactivating the pulse width modulated signal and the switching of switching devices 208 and 209. All signals are substantially at ground level (e.g., less than 300 mV) shortly after time $T_3$.

At time $T_4$, the enable signal transitions to a higher level in response to a request by controller 108 or a user input. The enable signal releases FETs 248 and 249 from a conducting state by reducing voltage at gates 260 to less than a threshold voltage. Diodes 254 and 255 become forward biased and drain charge from capacitors 250 and 251 when the enable signal is at a higher level.

It should be noted that the GENABLE_N input described in FIG. 2B is an inverted version of the enable signal in FIG. 3.

The error voltage, reference voltage, and regulator output voltage increase monotonically after the enable signal transitions to a higher state. In this way, the switching regulator of the lighting system may be activated and deactivated without causing unwanted transient changes in lighting system output voltage and current.

Referring now to FIG. 4, an example method for operating a lighting system is shown. The method of FIG. 4 may be stored as executable instructions in non-transitory memory of controller 108. Additionally, the method of FIG. 4 may be applied to the lighting system described in FIGS. 1-3.

At 402, method 400 judges whether or not to activate a lighting system. The lighting system may be activated in response to a controller or an input device such as a switch operated by a person. If method 400 judges to activate the lighting system, method 400 proceeds to 404. Otherwise, method 400 proceeds to 420.

At 404, method 400 releases a reference voltage and an error voltage from a ground level. In one example, the error voltage is an output of an amplifier that outputs a difference between the reference voltage and a sum of voltages at anodes and cathodes of lighting devices. Of course, the output of the switching regulator affects the voltages developed at lighting device anodes and cathodes. The reference voltage is a voltage provided via a voltage divider circuit that represents a desired voltage at a drain of FET 271. The reference voltage and error voltage may be released from ground via open circuiting (e.g., causing the transistors to not conduct) one or more transistors positioned between the reference voltage and ground as well as between the error voltage and ground. Method 400 proceeds to 406 after the reference voltage and the error voltage are released from ground.

At 406, method 400 provides a reference voltage for adjusting timing of switching regulator switching. In one example, the reference voltage is provided via a fixed supply voltage and a voltage divider comprising two resistors. Method 400 proceeds to 408 after the reference voltage is provided.

At 408, method 400 provides an error voltage from the reference voltage and lighting device anode and cathode voltages. In one example, the error voltage is provided via the circuit shown in FIGS. 2A-2C. Method 400 proceeds to 410 after the error voltage is provided.

At 410, method 400 adjusts a duty cycle of a switching regulator in response to the error voltage. In one example, the duty cycle is adjusted via changing the output of a comparator as described in FIGS. 2A-2C. The comparator output is then directed to a current driver for operating one or more FET switches as described in FIGS. 2A-2C. Method 400 proceeds to 412 after adjusting the switching regulator duty cycle.

At 412, method 400 supplies a voltage to one or more lighting devices. In one example, the voltage is supplied via an output of an inductor, the inductor including an input that is switched between a voltage source and ground to regulate the output of the inductor. FIGS. 2A-2C show an example switching regulator and inductor. Method 400 proceeds to exit after output from the inductor is directed to the lighting devices.

At 420, method 400 pulls a reference voltage to a ground level. The reference voltage is pulled or driven toward ground via activating a transistor electrically coupled to the reference voltage and ground. Activating the transistor to causes it to conduct and thereby provides a current path between the reference voltage and ground. Method 400 proceeds to 422 after the reference voltage is pulled to ground.

At 422, method 400 delays a threshold time period between when the reference voltage is pulled to ground and when the error voltage is pulled to ground. The threshold amount of time allows the switching regulator output to ramp toward ground before the switching devices are deactivated. Method 400 proceeds to 424 after the delay threshold period is exceeded.

At 424, method 400 pulls the error voltage to a ground level. The error voltage is pulled or driven toward ground via activating a transistor electrically coupled to the source of the error voltage (e.g., an amplifier) and ground. Activating the transistor causes it to conduct and thereby provides a current path between the error voltage and ground. Method 400 proceeds to 426 after the error voltage is pulled to ground.

At 426, the switching regulator stops switching in response to the error voltage being drive to ground. In particular, the error voltage causes an output of a comparator from changing state so that FETs switching an input of an inductor between ground and a higher voltage are deactivated. Method 400 proceeds to 428 after switching regulator switching is ceased.

At 428, method 400 drives switching regulator voltage output to ground. Since the input to the inductor is not switching, the inductor cannot generate a field to store and release energy. Consequently, the output of the inductor approaches ground level. Method 400 proceeds to exit after the regulator output is driven to ground.

Thus, method 400 provides for operating one or more light emitting devices, comprising: supplying electrical power to one or more light emitting devices via a switching regulator; and pulling a reference voltage indicative of a desired lighting source voltage toward ground in response to a request to cease supplying the electrical power to the one or more light emitting devices. The method further comprises pulling an error voltage indicative of an error between a desired level of electrical power supplied to the one or more light emitting devices and an actual level of electrical power supplied to the one or more light emitting devices toward ground. In some examples, the method further comprises biasing an input of a comparator that provides a pulse width modulated signal within the switching regulator. The bias reduces the possibility of inadvertent switching of the switching regulator. The method further comprises releasing the reference voltage indicative of the desired lighting source voltage from ground. The method further comprises releasing the error voltage from ground. The method also includes where the error voltage and the reference voltage are released from ground via a single input, and where the error voltage and the reference voltage are released from ground at different times.

Figure 5:
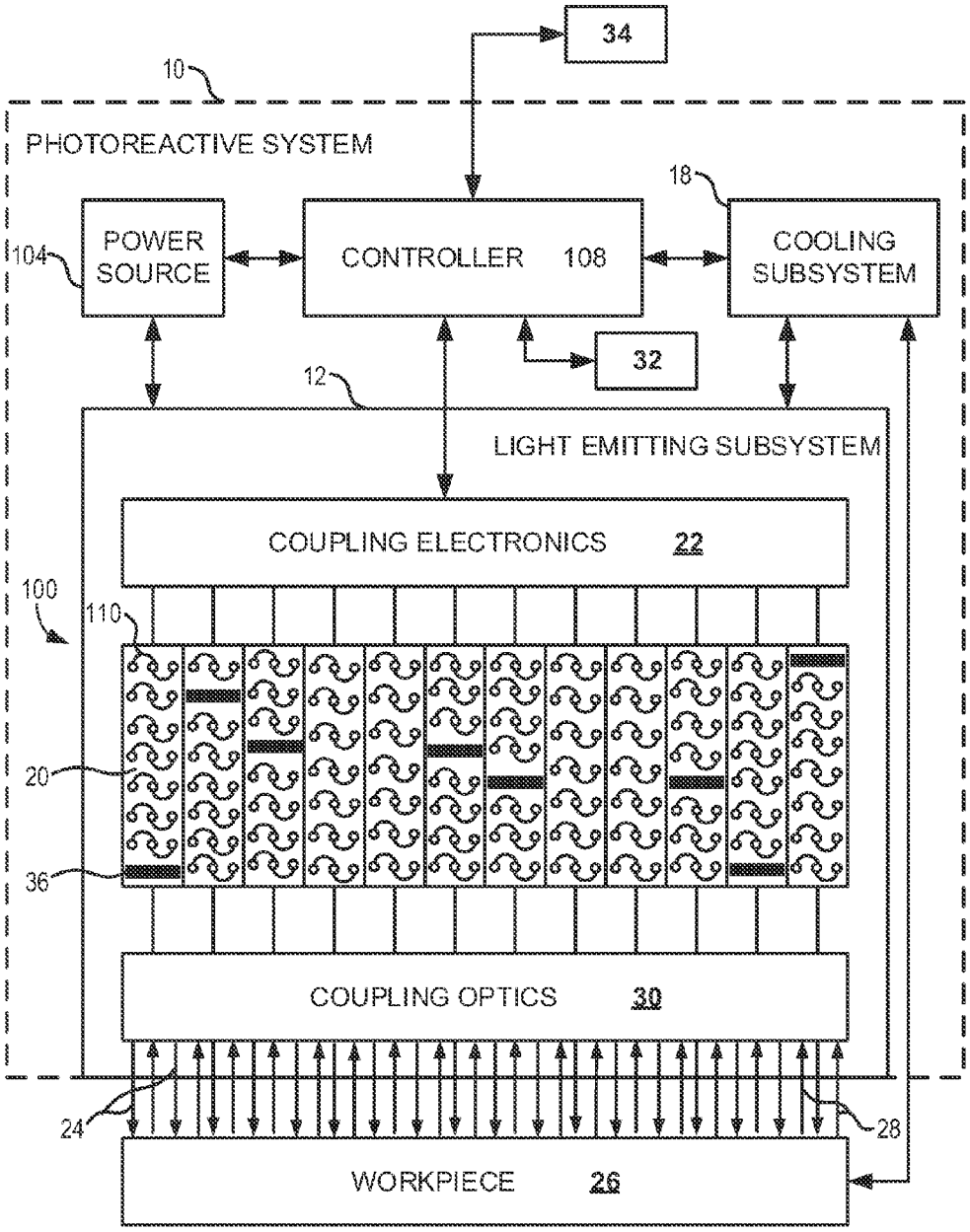
FIG. 5 shows an example depiction of a photoreactive system.

Referring now to FIG. 5, a block diagram of a photoreactive system 10 in accordance with the system and method described herein is shown. In this example, the photoreactive system 10 comprises a lighting subsystem 100, a controller 108, a voltage regulator 104 and a cooling subsystem 18.

The lighting subsystem 100 may comprise a plurality of light emitting devices 110. Light emitting devices 110 may be LED devices, for example. Selected of the plurality of light emitting devices 110 are implemented to provide radiant output 24. The radiant output 24 is directed to a work piece 26. Returned radiation 28 may be directed back to the lighting subsystem 100 from the work piece 26 (e.g., via reflection of the radiant output 24).

The radiant output 24 may be directed to the work piece 26 via coupling optics 30. The coupling optics 30, if used, may be variously implemented. As an example, the coupling optics may include one or more layers, materials or other structure interposed between the light emitting devices 110 providing radiant output 24 and the work piece 26. As an example, the coupling optics 30 may include a micro-lens array to enhance collection, condensing, collimation or otherwise the quality or effective quantity of the radiant output 24. As another example, the coupling optics 30 may include a micro-reflector array. In employing such micro-reflector array, each semiconductor device providing radiant output 24 may be disposed in a respective micro-reflector, on a one-to-one basis.

Each of the layers, materials or other structure may have a selected index of refraction. By properly selecting each index of refraction, reflection at interfaces between layers, materials and other structure in the path of the radiant output 24 (and/or returned radiation 28) may be selectively controlled. As an example, by controlling differences in such indexes of refraction at a selected interface disposed between the semiconductor devices to the work piece 26, reflection at that interface may be reduced, eliminated, or minimized, so as to enhance the transmission of radiant output at that interface for ultimate delivery to the work piece 26.

The coupling optics 30 may be employed for various purposes. Example purposes include, among others, to protect the light emitting devices 110, to retain cooling fluid associated with the cooling subsystem 18, to collect, condense and/or collimate the radiant output 24, to collect, direct or reject returned radiation 28, or for other purposes, alone or in combination. As a further example, the photoreactive system 10 may employ coupling optics 30 so as to enhance the effective quality or quantity of the radiant output 24, particularly as delivered to the work piece 26.

Selected of the plurality of light emitting devices 110 may be coupled to the controller 108 via coupling electronics 22, so as to provide data to the controller 108. As described further below, the controller 108 may also be implemented to control such data-providing semiconductor devices, e.g., via the coupling electronics 22.

The controller 108 preferably is also connected to, and is implemented to control, each of the voltage regulator 104 and the cooling subsystem 18. Moreover, the controller 108 may receive data from voltage regulator 104 and cooling subsystem 18.

In addition to the voltage regulator 104, cooling subsystem 18 and lighting subsystem 100, the controller 108 may also be connected to, and implemented to control elements 32, 34. Element 32, as shown, may be internal to the photoreactive system 10. Element 34, as shown, is external of the photoreactive system 10, but may be associated with the work piece 26 (e.g., handling, cooling or other external equipment) or may be otherwise related to the photoreaction that photoreactive system 10 supports.

The data received by the controller 108 from one or more of the voltage regulator 104, the cooling subsystem 18, the lighting subsystem 100, and/or elements 32, 34, may be of various types. As an example the data may be representative of one or more characteristics associated with coupled semiconductor devices 110, respectively. As another example, the data may be representative of one or more characteristics associated with the respective component 12, 16, 18, 32, 34 providing the data. As still another example, the data may be representative of one or more characteristics associated with the work piece 26 (e.g., representative of the radiant output energy or spectral component(s) directed to the work piece). Moreover, the data may be representative of some combination of these characteristics.

The controller 108, in receipt of any such data, may be implemented to respond to that data. For example, responsive to such data from any such component, the controller 108 may be implemented to control one or more of the voltage regulator 104, cooling subsystem 18, lighting subsystem 100 (including one or more such coupled semiconductor devices), and/or the elements 32, 34. As an example, responsive to data from the lighting subsystem indicating that the light energy is insufficient at one or more points associated with the work piece, the controller 108 may be implemented to either (a) increase the power source's supply of power to one or more of the semiconductor devices, (b) increase cooling of the lighting subsystem via the cooling subsystem 18 (i.e., certain light emitting devices, if cooled, provide greater radiant output), (c) increase the time during which the power is supplied to such devices, or (d) a combination of the above.

Individual semiconductor devices 110 (e.g., LED devices) of the lighting subsystem 100 may be controlled independently by controller 108. For example, controller 108 may control a first group of one or more individual LED devices to emit light of a first intensity, wavelength, and the like, while controlling a second group of one or more individual LED devices to emit light of a different intensity, wavelength, and the like. The first group of one or more individual LED devices may be within the same array of semiconductor devices 110, or may be from more than one array of semiconductor devices 110. Arrays of semiconductor devices 110 may also be controlled independently by controller 108 from other arrays of semiconductor devices 110 in lighting subsystem 100 by controller 108. For example, the semiconductor devices of a first array may be controlled to emit light of a first intensity, wavelength, and the like, while those of a second array may be controlled to emit light of a second intensity, wavelength, and the like.

As a further example, under a first set of conditions (e.g. for a specific work piece, photoreaction, and/or set of operating conditions) controller 108 may operate photoreactive system 10 to implement a first control strategy, whereas under a second set of conditions (e.g. for a specific work piece, photoreaction, and/or set of operating conditions) controller 108 may operate photoreactive system 10 to implement a second control strategy. As described above, the first control strategy may include operating a first group of one or more individual semiconductor devices (e.g., LED devices) to emit light of a first intensity, wavelength, and the like, while the second control strategy may include operating a second group of one or more individual LED devices to emit light of a second intensity, wavelength, and the like. The first group of LED devices may be the same group of LED devices as the second group, and may span one or more arrays of LED devices, or may be a different group of LED devices from the second group, and the different group of LED devices may include a subset of one or more LED devices from the second group.

The cooling subsystem 18 is implemented to manage the thermal behavior of the lighting subsystem 100. For example, generally, the cooling subsystem 18 provides for cooling of such subsystem 12 and, more specifically, the semiconductor devices 110. The cooling subsystem 18 may also be implemented to cool the work piece 26 and/or the space between the piece 26 and the photoreactive system 10 (e.g., particularly, the lighting subsystem 100). For example, cooling subsystem 18 may be an air or other fluid (e.g., water) cooling system.

The photoreactive system 10 may be used for various applications. Examples include, without limitation, curing applications ranging from ink printing to the fabrication of DVDs and lithography. Generally, the applications in which the photoreactive system 10 is employed have associated parameters. That is, an application may include associated operating parameters as follows: provision of one or more levels of radiant power, at one or more wavelengths, applied over one or more periods of time. In order to properly accomplish the photoreaction associated with the application, optical power may need to be delivered at or near the work piece at or above a one or more predetermined levels of one or a plurality of these parameters (and/or for a certain time, times or range of times).

In order to follow an intended application's parameters, the semiconductor devices 110 providing radiant output 24 may be operated in accordance with various characteristics associated with the application's parameters, e.g., temperature, spectral distribution and radiant power. At the same time, the semiconductor devices 110 may have certain operating specifications, which may be are associated with the semiconductor devices' fabrication and, among other things, may be followed in order to preclude destruction and/or forestall degradation of the devices. Other components of the photoreactive system 10 may also have associated operating specifications. These specifications may include ranges (e.g., maximum and minimum) for operating temperatures and applied, electrical power, among other parameter specifications.

Accordingly, the photoreactive system 10 supports monitoring of the application's parameters. In addition, the photoreactive system 10 may provide for monitoring of semiconductor devices 110, including their respective characteristics and specifications. Moreover, the photoreactive system 10 may also provide for monitoring of selected other components of the photoreactive system 10, including their respective characteristics and specifications.

Providing such monitoring may enable verification of the system's proper operation so that operation of photoreactive system 10 may be reliably evaluated. For example, the system 10 may be operating improperly with respect to one or more of the application's parameters (e.g., temperature, radiant power, etc.), any components characteristics associated with such parameters and/or any component's respective operating specifications. The provision of monitoring may be responsive and carried out in accordance with the data received by controller 108 by one or more of the system's components.

Monitoring may also support control of the system's operation. For example, a control strategy may be implemented via the controller 108 receiving and being responsive to data from one or more system components. This control, as described above, may be implemented directly (i.e., by controlling a component through control signals directed to the component, based on data respecting that components operation) or indirectly (i.e., by controlling a component's operation through control signals directed to adjust operation of other components). As an example, a semiconductor device's radiant output may be adjusted indirectly through control signals directed to the voltage regulator 104 that adjust power applied to the lighting subsystem 100 and/or through control signals directed to the cooling subsystem 18 that adjust cooling applied to the lighting subsystem 100.

Control strategies may be employed to enable and/or enhance the system's proper operation and/or performance of the application. In a more specific example, control may also be employed to enable and/or enhance balance between the array's radiant output and its operating temperature, so as, e.g., to preclude heating the semiconductor devices 110 or array of semiconductor devices 110 beyond their specifications while also directing radiant energy to the work piece 26 sufficient to properly complete the photoreaction(s) of the application.

In some applications, high radiant power may be delivered to the work piece 26. Accordingly, the subsystem 12 may be implemented using an array of light emitting semiconductor devices 110. For example, the subsystem 12 may be implemented using a high-density, light emitting diode (LED) array. Although LED arrays may be used and are described in detail herein, it is understood that the semiconductor devices 110, and array(s) of same, may be implemented using other light emitting technologies without departing from the principles of the description, examples of other light emitting technologies include, without limitation, organic LEDs, laser diodes, other semiconductor lasers.

The plurality of semiconductor devices 110 may be provided in the form of an array 20, or an array of arrays (as shown in FIG. 5). The array 20 may be implemented so that one or more, or most of the semiconductor devices 110 are configured to provide radiant output. At the same time, however, one or more of the array's semiconductor devices 110 are implemented so as to provide for monitoring selected of the array's characteristics. The monitoring devices 36 may be selected from among the devices in the array 20 and, for example, may have the same structure as the other, emitting devices. For example, the difference between emitting and monitoring may be determined by the coupling electronics 22 associated with the particular semiconductor device (e.g., in a basic form, an LED array may have monitoring LEDs where the coupling electronics provides a reverse current, and emitting LEDs where the coupling electronics provides a forward current).

Furthermore, based on coupling electronics, selected of the semiconductor devices in the array 20 may be either/both multifunction devices and/or multimode devices, where (a) multifunction devices are capable of detecting more than one characteristic (e.g., either radiant output, temperature, magnetic fields, vibration, pressure, acceleration, and other mechanical forces or deformations) and may be switched among these detection functions in accordance with the application parameters or other determinative factors and (b) multimode devices are capable of emission, detection and some other mode (e.g., off) and are switched among modes in accordance with the application parameters or other determinative factors.

As will be appreciated by one of ordinary skill in the art, the methods described in FIG. 5 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, lighting sources producing different wavelengths of light may take advantage of the present description.

The invention claimed is:

1. A system for operating one or more light emitting devices, comprising:

a discrete voltage regulating circuit including a switching device and a voltage reference source;

a switching device deactivation circuit including a switch positioned in a first current path between the voltage reference source and ground;

a timing circuit;

a comparator;

a current driving device, the timing circuit in electrical communication with the comparator, the comparator in electrical communication with the current driving device, and the current driving device in electrical communication with the switching device; and a controller including executable non-transitory instructions for selectively activating and deactivating the switching device deactivation circuit via the switch.

2. The system of claim 1, where the switch in the switching device deactivation circuit is a FET, JFET, MOSFET, or bipolar transistor.

3. The system of claim 2, where the switching device deactivation circuit further comprises a capacitor electrically coupled to a gate or base of the switching device and ground.

4. The system of claim 3, where the switching device deactivation circuit further comprises a resistor and a diode in electrical communication with the capacitor and the gate or base of the switching device.

5. The system of claim 1, further comprising a biasing resistor, the biasing resistor electrically coupled to ground and the timing circuit.

6. A system for operating one or more light emitting devices, comprising:

a discrete voltage regulating circuit including a switching device, a voltage reference source, and an error voltage source; and a switching device deactivation circuit including a first switch positioned in a first current path between the voltage reference source and ground, the switching device deactivation circuit also including a second switch positioned in a second current path between the error voltage source and ground, where first and second switches are FETs, JFETs, MOSFETs, or bipolar transistors, the switching device deactivation circuit further comprising a first capacitor electrically coupled to a gate or base of the first switch and ground, and the switching device deactivation circuit further comprising a second capacitor electrically coupled to a gate or base of the second switch and ground.

7. The system of claim 6, where the switching device deactivation circuit further comprises a first diode and a first resistor electrically coupled to the first capacitor, and where the switching device deactivation circuit further comprises a second diode and a second resistor electrically coupled to the second capacitor.

8. The system of claim 7, where the first diode, the second diode, the first resistor, and the second resistor are in electrical communication with an enabling signal source.

9. The system of claim 6, further comprising a timing circuit, a comparator, and a current driving device.

10. The system of claim 9, where the timing circuit is in electrical communication with the comparator, where the comparator is in electrical communication with the current driving device, and where the current driving device is in electrical communication with the switching device.

11. The system of claim 10, further comprising a bias resistor, the bias resistor positioned between the timing circuit and ground.

12. A method for operating one or more light emitting devices, comprising:

supplying electrical power to one or more light emitting devices via a switching regulator;

pulling a reference voltage indicative of a desired lighting source voltage toward ground in response to a request to cease supplying the electrical power to the one or more light emitting devices;

pulling an error voltage indicative of an error between a desired level of electrical power supplied to the one or more light emitting devices and an actual level of electrical power supplied to the one or more light emitting devices toward ground; and biasing an input of a comparator that provides a pulse width modulated signal within the switching regulator.

13. The method of claim 12, further comprising releasing the reference voltage indicative of the desired lighting source voltage from ground.

14. The method of claim 13, further comprising releasing the error voltage from ground.

15. The method of claim 14, where the error voltage and the reference voltage are released from ground via a single input, and where the error voltage and the reference voltage are released from ground at different times.

* * * * *